US005868265A

United States Patent [19]

Kobayashi

[11] Patent Number: 5,868,265

[45] Date of Patent: Feb. 9, 1999

[54] CONTAINER CAP INCLUDING A PRIMARY CAP AND A SECONDARY CAP JOINED BY A HINGE

[75] Inventor: Yasutomo Kobayashi, Kanagawa-ken, Japan

[73] Assignee: Nifco, Inc., Kanagawa-ken, Japan

[21] Appl. No.: 802,804

[22] Filed: Feb. 18, 1997

Related U.S. Application Data

[63] Continuation-in-part of Ser. No. 524,059, Sep. 6, 1995, abandoned.

[51] Int. Cl.[6] ..... B65D 43/14

[52] U.S. Cl. ..... 215/235; 220/339; 220/259

[58] Field of Search ..... 215/235, 237, 215/238; 220/335, 339, 259; 222/546, 556, 562

[56] References Cited

U.S. PATENT DOCUMENTS

| | | | |
|---|---|---|---|
| 4,172,540 | 10/1979 | Erichson | 215/235 X |
| 4,813,560 | 3/1989 | Begley | 215/235 |
| 5,065,911 | 11/1991 | Rohr et al. | 215/235 X |
| 5,392,938 | 2/1995 | Dubach | 215/237 X |
| 5,494,185 | 2/1996 | Dubach | 215/235 X |
| 5,501,348 | 3/1996 | Takeuchi | 215/235 |

*Primary Examiner*—Stephen K. Cronin
*Assistant Examiner*—Nathan Newhouse
*Attorney, Agent, or Firm*—Skjerven Morrill MacPherson Franklin & Friel LLP; Thomas S. MacDonald

[57] ABSTRACT

Provided is a convenient container cap which can be integrally molded from synthetic resin material, and comprises a primary cap adapted to be fitted on an opening of a container and provided with an outlet opening in a top wall thereof, and a secondary cap attached to the primary cap with a reversible hinge and provided with a plug member adapted to be fitted into the outlet opening of the primary cap. According to one aspect of the present invention, the reversible hinge comprises a resilient piece connected between the top wall 3 of the primary cap and an inner surface of the secondary cap, in each case, in a region located more radially inwardly that a flexible thinned hinge portion so that the external appearance of the reversible hinge is improved. According to another aspect of the present invention, a slide member is also integrally attached to the primary cap for reducing the effort required to open the secondary cap without increasing the number of component parts or complicating the assembling process.

7 Claims, 10 Drawing Sheets

CONTAINER CAP INCLUDING A PRIMARY CAP AND A SECONDARY CAP JOINED BY A HINGE

CROSS REFERENCE TO RELATED APPLICATION

This application is a continuation-in-part of U.S. application Ser. No. 08/524,059 filed Sep. 6, 1995, now abandoned.

TECHNICAL FIELD

The present invention relates to a cap adapted to be fitted on an opening of a container for foods, drugs and cosmetics, and in particular to a cap having a secondary cap hinged to a primary cap via a reversible hinge which reverses the resilient urging force thereof from an opening direction to a closing direction or vice versa depending on the angular position of the cap.

BACKGROUND OF THE INVENTION

A cap made of synthetic resin material is often fitted on an opening of a container for foods, drugs and cosmetics. The cap often consists of a primary cap having an outlet opening at a top wall thereof, and a secondary cap adapted to close this outlet opening.

For instance, Japanese utility model publication (kokai) No. 1-66355 discloses a container cap including a primary cap 1 and a secondary cap 2 which are joined together by a pair of flexible hinge strips 3*a* having a reduced thickness, and also by a resilient piece 3*b* so that the direction of the biasing force of the resilient piece may be reversed from the closing direction to the opening direction and vice versa depending on the angular position of the secondary cap. This utility model publication also discloses a plate member 4 which is slidably guided on a top surface of the primary cap and provided with a tapered surface 5, and allows the secondary cap to be opened up with a single hand by pushing the plate member which in turn pushes up the secondary cap with its tapered surface and pushes the inner surface of the resilient piece 3*b* with a free end 6 thereof.

However, according to this prior art, the thinned hinge portions show on the exterior in two places, and the resilient piece protrudes outward when the secondary cap is opened. These facts are highly detrimental to the external appearance. This conventional cap provides the advantage of allowing the secondary cap to be opened up with a single hand but involves a large number of fabricating and assembling work steps and a complex management of the component parts because a slidable member is made of a separate member, and needs to be molded separately and assembled to the primary cap.

BRIEF SUMMARY OF THE INVENTION

In view of such problems of the prior art, a primary object of the present invention is to provide a container cap including a primary cap and a secondary cap joined by a reversible hinge which minimizes the part of the hinge showing on the exterior of the container and having no pronounced external protrusions.

A second object of the present invention is to provide a container cap including a primary cap and a secondary cap joined by a reversible hinge which can be opened up with a single hand, and can be made from a small number of component parts.

A third object of the present invention is to provide a container cap including a primary cap and a secondary cap joined by a reversible hinge which is convenient to use and easy to fabricate.

These and other objects of the present invention can be accomplished by providing a container cap integrally molded from synthetic resin material, comprising: a primary cap adapted to be fitted on an opening of a container, and provided with an outlet opening in a top wall thereof; and a secondary cap attached to the primary cap with hinge means, and provided with a plug member adapted to be closely fitted into the outlet opening of the primary cap; the hinge means comprising a thin strip integrally molded with a top end of the primary cap and a bottom end of the secondary cap, and a resilient piece integrally molded with one of the primary cap and the secondary cap and attached to the other of the primary cap and the secondary cap, in each case, at a point slightly more inwardly than the thin strip, the resilient piece being configured as a reversible hinge which reverses a direction of a biasing force thereof at a certain critical opening angle of the secondary cap.

Thus, because the hinge means may consist of an integrally molded single thin strip for connecting the primary cap to the secondary cap, and the resilient piece may be hidden inside the thin strip, the externally exposed portions of the hinge means can be minimized, and the resilient piece can be totally concealed. In particular, because the resilient piece has a somewhat complex shape, and makes a relatively large flexing movement, the concealment of the resilient piece is highly effective in improving the external appearance of the hinge means. Because only one end of the resilient piece is integrally molded with the cap, the molding process is kept easy. The free end of the resilient piece can be readily attached to the primary cap or the secondary cap, as the case may be, by snap fitting it into a slit formed in the associated part.

According to a preferred embodiment of the present invention, the primary cap is generally cylindrical in shape, and the thin strip joins an upper axial end of a side wall of the primary cap with an associated lower peripheral portion of the secondary cap. Preferably, the resilient piece is provided with a pair of thinned portions provided adjacent to the primary cap and the secondary cap, respectively. For the convenience of the handling of the container cap, the secondary cap may be provided with a finger catch on a side wall diagonally opposite to the hinge means.

According to another aspect of the present invention, there is provided a container cap integrally molded from synthetic resin material, comprising: a primary cap adapted to be fitted on an opening of a container, and provided with an outlet opening in a top wall thereof; a secondary cap attached to the primary cap with first hinge means, and provided with a plug member adapted to be fitted into the outlet opening of the primary cap; a slide member attached to the primary cap, diagonally opposite to the secondary cap, with second hinge means; and guide means for slidably guiding the slide member along an upper surface of the primary cap; the slide member being provided with slope means cooperating with an associated slope means provided in the secondary cap for converting a sliding movement of the slide member into an upward movement of the secondary cap, the first hinge means being configured as a reversible hinge which reverses a direction of a biasing force thereof at a certain critical opening angle of the secondary cap.

According to this structure, the primary cap, the secondary cap, the pressure member and the slide member can be all integrally molded from synthetic resin material.

Furthermore, the secondary cap can be opened up with a single hand, and the entire cap assembly can be made from a small number of component parts or from a single component part.

According to a preferred embodiment of the present invention, the second hinge means is provided in a lower part of the primary cap, and the slide member further comprises a pressure member provided adjacent the second hinge means, and extending along a side wall of the primary cap so that the sliding movement of the slide member may be effected by pressing the pressure member toward the side wall of the primary cap. To achieve a favorable external appearance, the pressure member and a surrounding part of the primary cap may be configured so as to define a continuous contour.

It is also advantageous if the slide member generally overlies the outlet opening, and is provided with a slot exposing the outlet opening. Preferably, the slide member is received in a complementary recess provided in an upper surface of the primary cap. The slide member is required to be guided without rising out of the complementary recess during use, and it can be accomplished by providing a structure in which the guide means comprises a pair of lateral projections provided on either side of the slide member, and guide slots provided in side walls of the complementary recess for receiving the lateral projections.

According to one aspect of the present invention, the secondary cap can be lifted by moving the slide member which actuates the slope means, and further pushes the first hinge means to force the secondary cap in an opening direction. The slope means may comprise a pair of projections provided on an upper surface of the slide member on either side of the slot exposing the outlet opening, each defining a sloping surface, and the associated slope means may comprise a pair of projections provided on an inner surface of the secondary cap defining additional sloping surfaces each adapted to cooperate with an associated one of the sloping surfaces.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
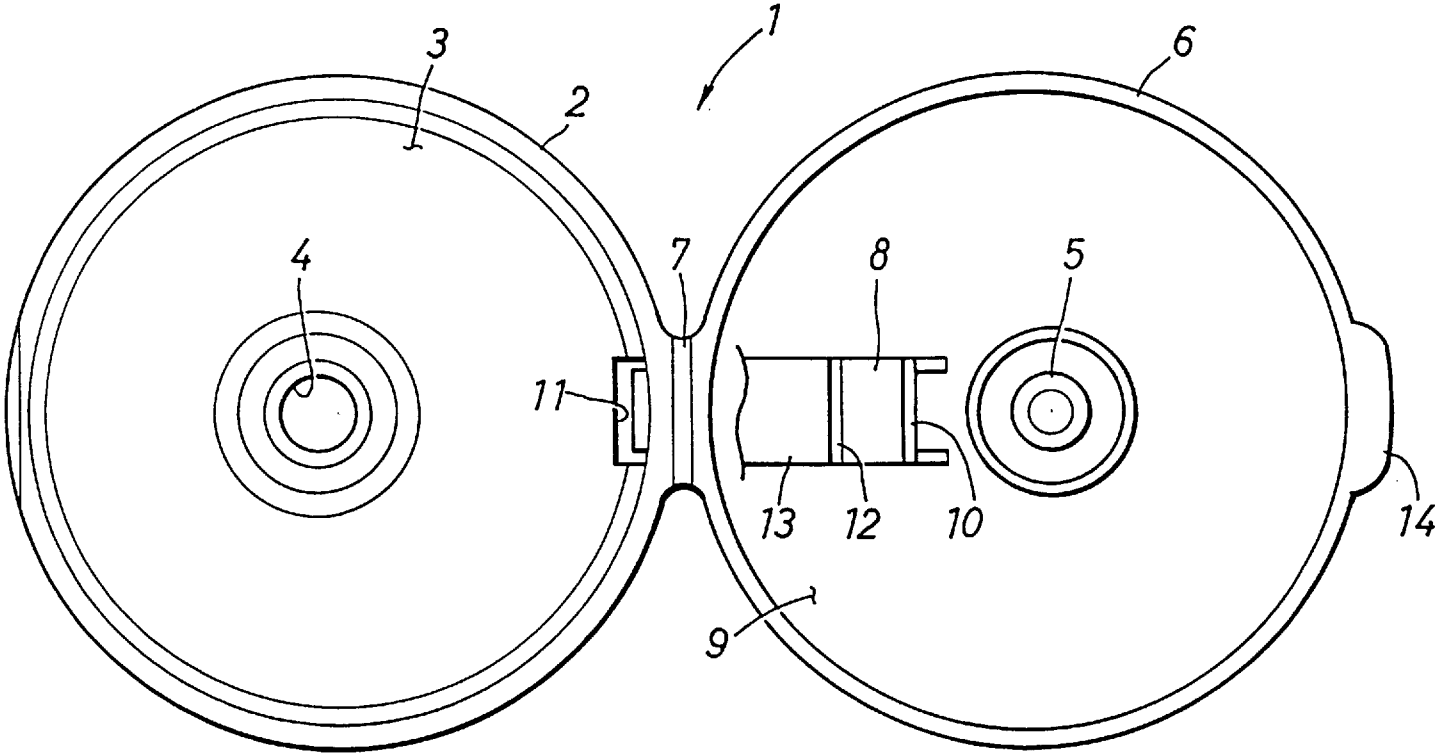
FIG. 1 is a plan view of a first embodiment of the container cap according to the present invention in its molded state.
Figure 2:
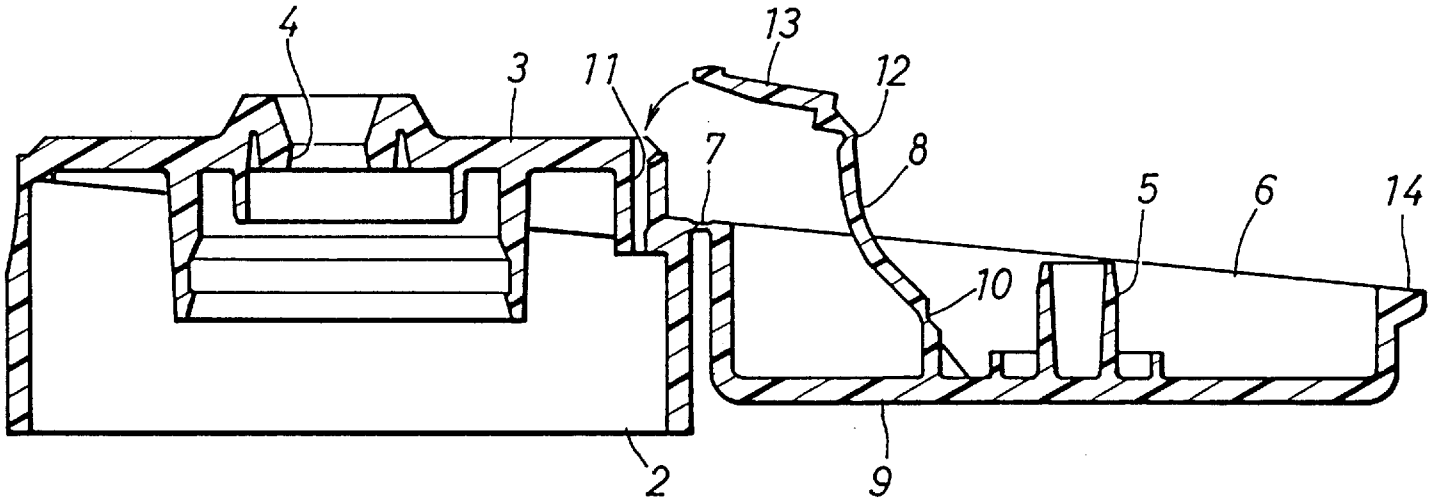
FIG. 2 is a longitudinal sectional view of the container cap of FIG. 1 in its molded state.
Figure 3:
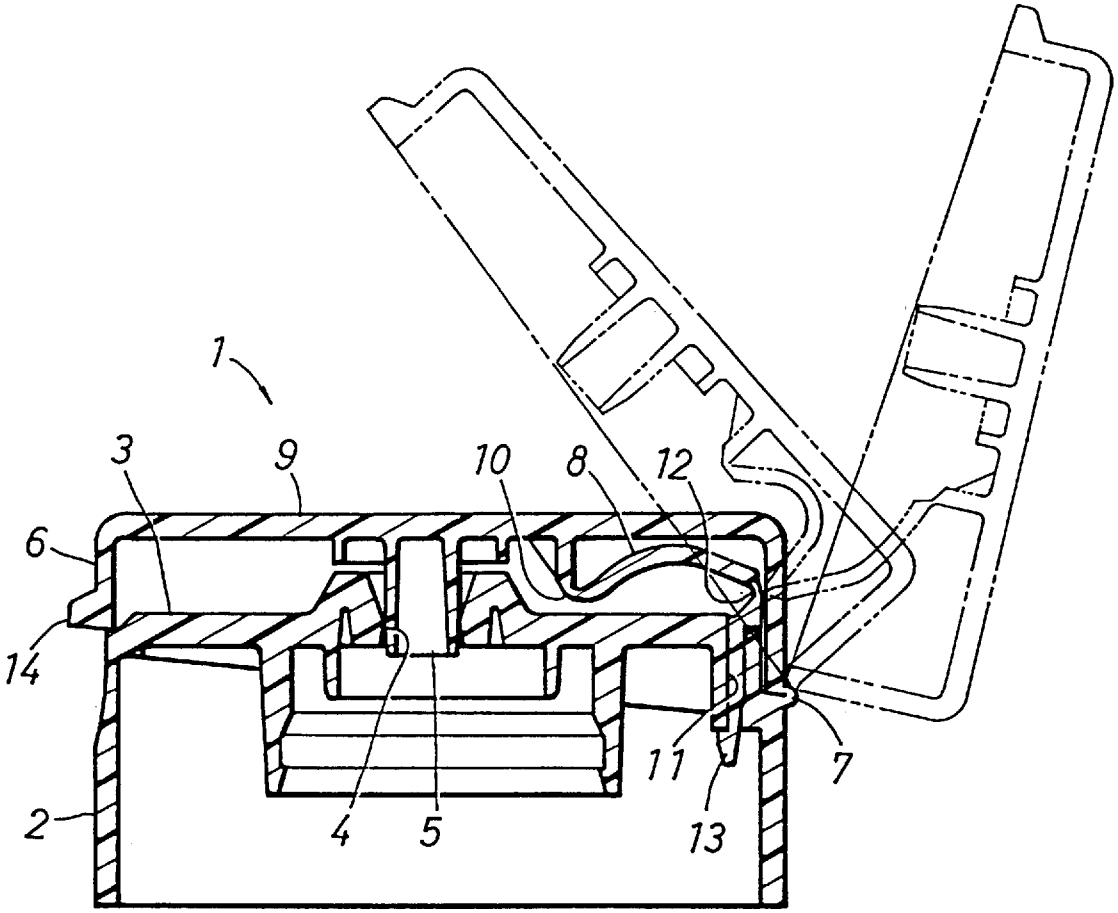
FIG. 3 is a longitudinal sectional view of the container cap with the secondary cap closed.
Figure 4:
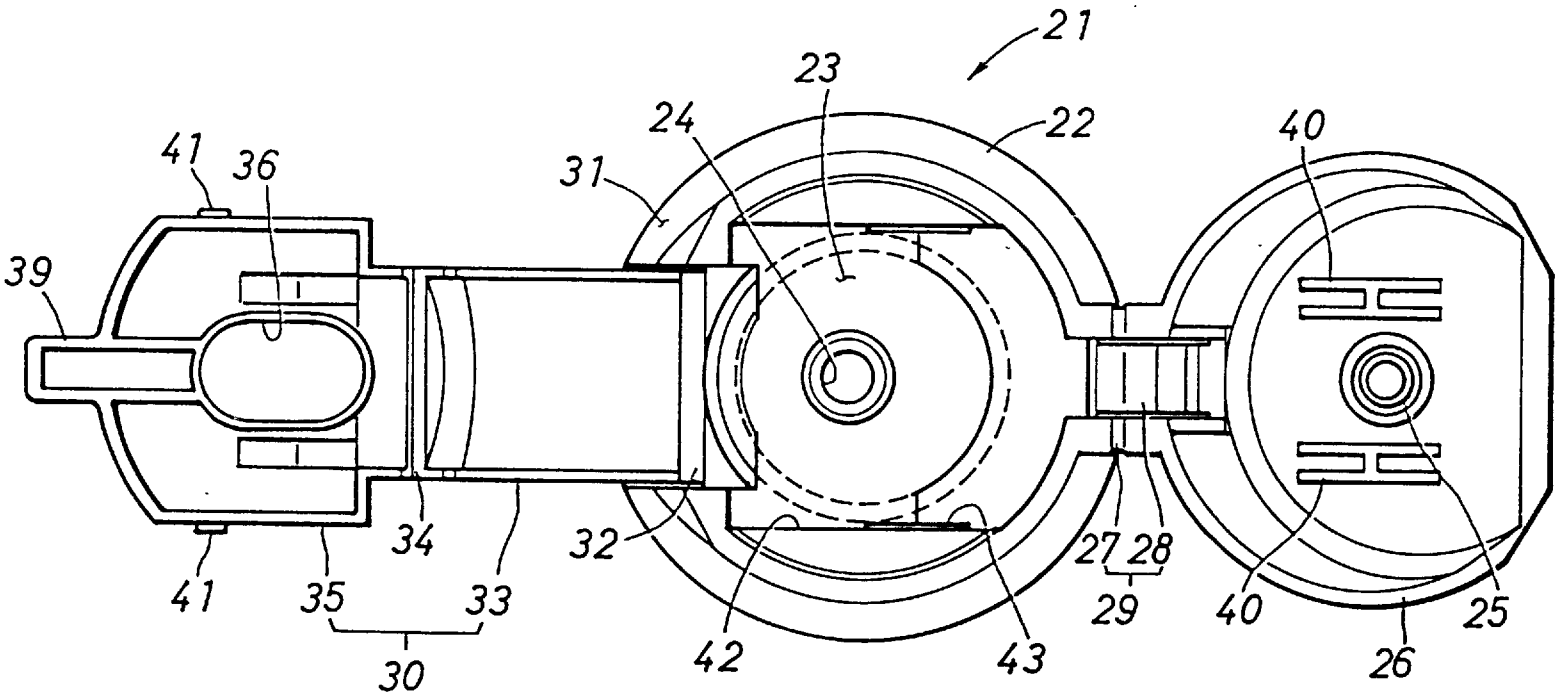
FIG. 4 is a plan view of a second embodiment of the container cap according to the present invention in its molded state.
Figure 5:
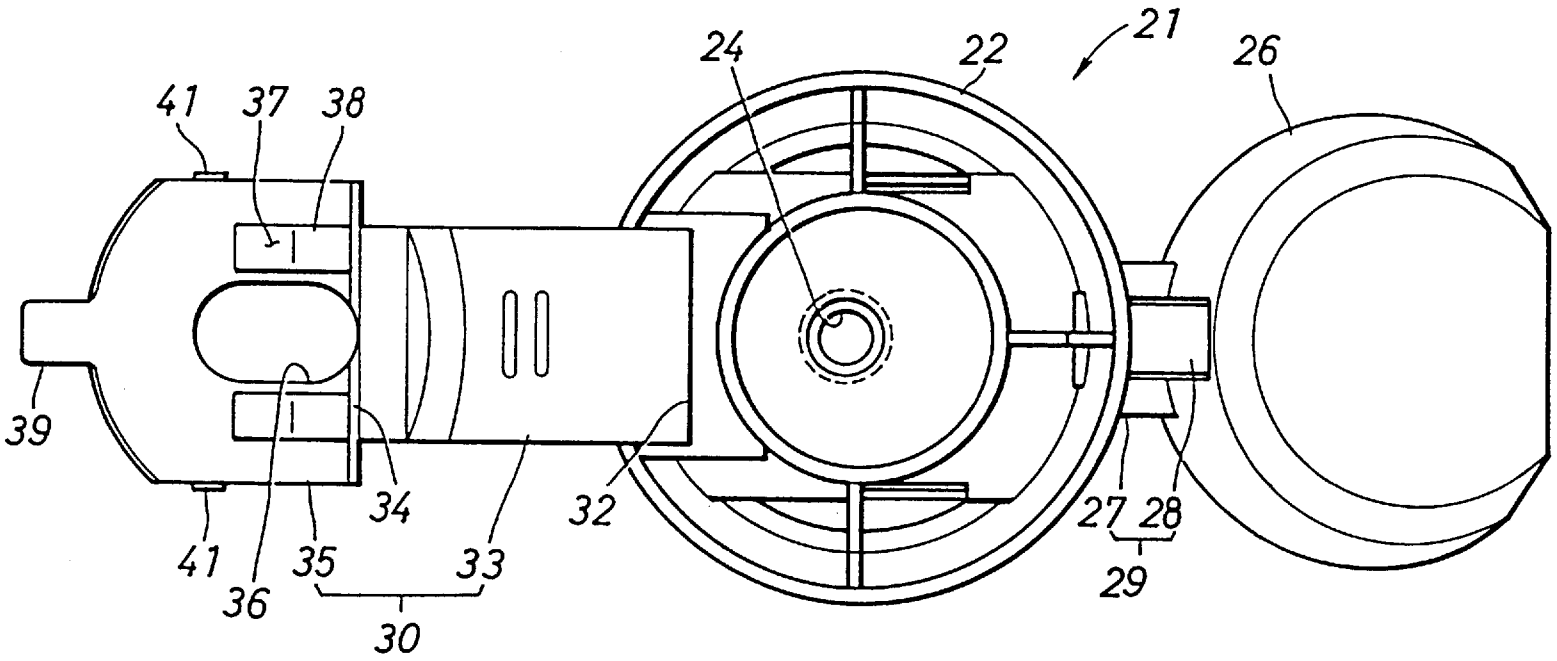
FIG. 5 is a bottom view of the container cap of FIG. 4 in its molded state.
Figure 6:
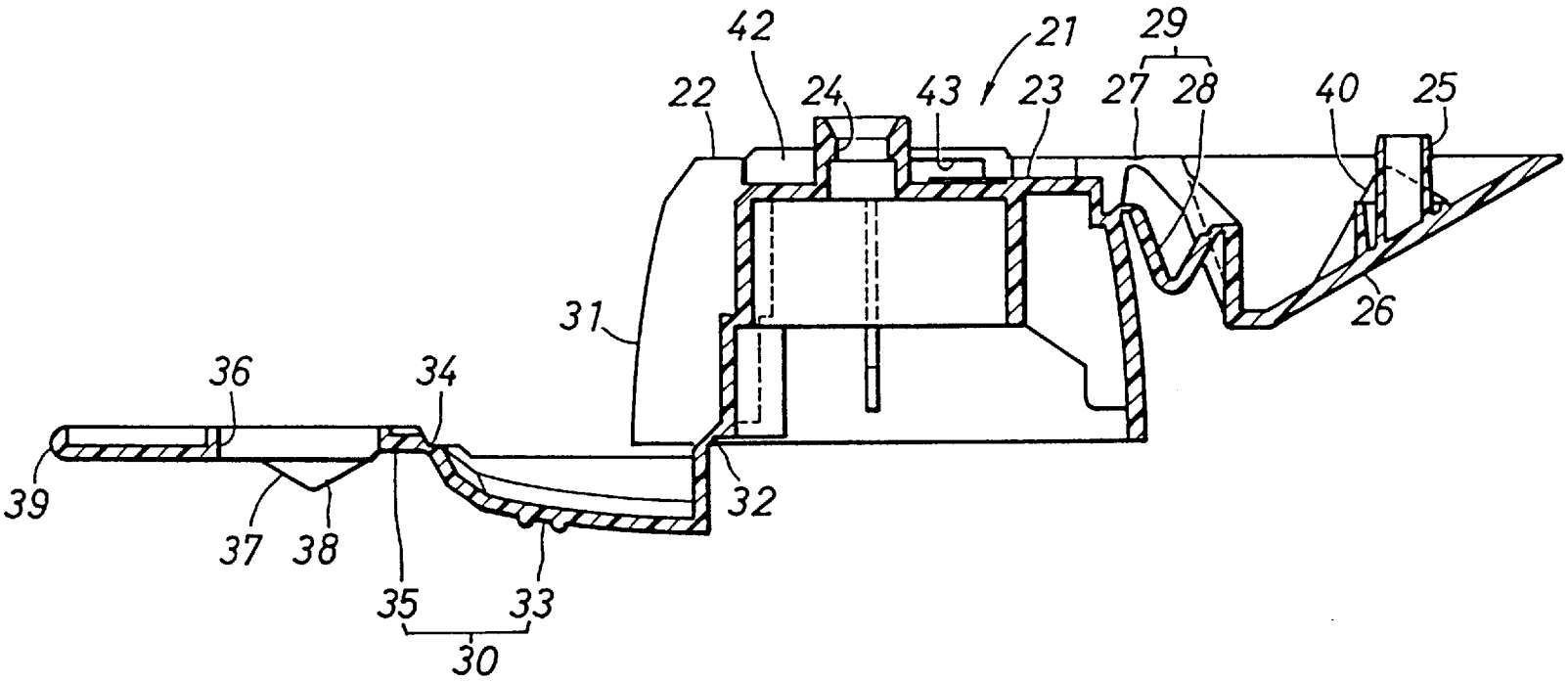
FIG. 6 is a longitudinal sectional view of the container cap of FIG. 4 in its molded state.
Figure 7:
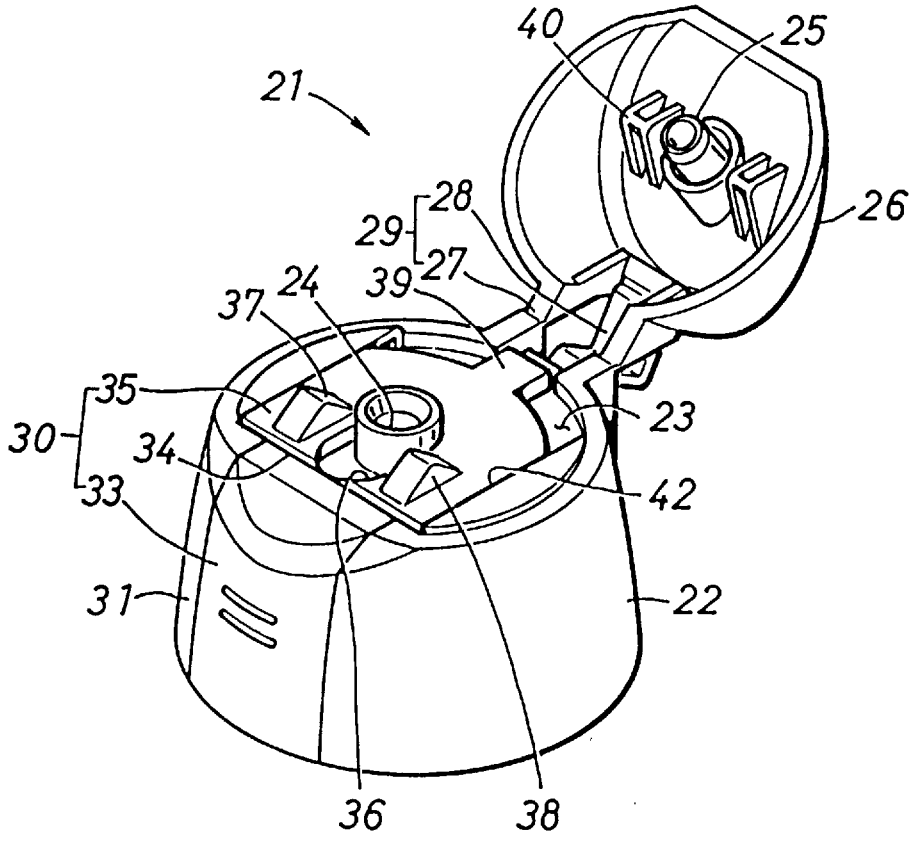
FIG. 7 is a perspective view of the container cap of FIG. 4 in its assembled state.

FIGS. 1 to 3 show a first embodiment of the container cap according to the present invention. This cap 1 is injection molded in its developed or unfolded condition as illustrated in FIGS. 1 and 2, and comprises a primary cap 2 which is generally cylindrical and cup-shaped and adapted to be fitted onto an opening of a container main body (not shown in the drawings) and a secondary cap 6 having a plug member 5 projecting from an inner surface thereof for closing an outlet opening 4 provided in a top wall 3 of the primary cap 2. The cap 1 is integrally molded from highly resilient synthetic resin material such as polypropylene. More specifically, these two parts 2 and 6 are joined together by a thin and flexible hinge portion 7 at axial end portions of the circumferential walls thereof.

A part of the inner surface of the secondary cap 6 radially adjacent to the plug member 5 is integrally provided with a resilient piece 8 for producing a reversible elastic force. This resilient piece 8 is provided with one end which is connected to the inner surface of the top wall 9 of the secondary cap 6 via a thinned hinge portion 10 and another end which forms an engagement piece 13 provided with a thinned hinge portion 12 so as to be flexible and adapted to be connected to the primary cap 2 by being fit into a slit 11 provided in a part of the secondary cap 2 radially and inwardly adjacent to the hinge portion 7.

Now the mode of assembling this container cap and the operation thereof are described in the following. First of all, the secondary cap 6 in the unfolded state is raised to an angle approximately equal to 90 degrees, and the tip of the engagement piece 13 is fitted into the slit 11. Because the tip of the engagement piece 13 is somewhat enlarged, once the engagement piece 13 is fully fitted into the slit 11, the tip of the engagement piece 13 is snap fitted and engaged by the inner edge of the slit 11, and is kept engaged therein. In this condition, the primary cap 2 is fitted onto the opening of the container main body in advance.

The resilient strip 8 is slightly curved in its natural state, and is deflected into the shape of letter-U when the secondary cap 6 is turned in the closing direction. When the resilient strip 8 is thus deflected, it produces an elastic force tending to restore itself to a straight condition, and can reverse the direction of its biasing force from the closing direction to the opening direction and vice versa at a certain critical angle (FIG. 3).

When the secondary cap 6 is closed and the tip of the plug member 5 projecting from the inner surface of the secondary cap 6 is fitted into the outlet opening 4 of the primary cap 2, the plug member 5 is kept engaged in the outlet opening 4 is a liquid tight condition by virtue of its own resiliency because the tip of the plug member 5 is slightly oversized as compared to the inner diameter of the outlet opening 4. Furthermore, the outlet opening 4 is defined by an annular lip which is designed to be highly resilient, and the inner bore is countersunk from both inside and outside.

The secondary cap 6 can be opened by pushing up a finger catch 14 projecting from an open end of the secondary cap 6. Once the secondary cap 6 is opened and the plug member 5 is removed from the outlet opening 4, the secondary cap 6 is opened to an angle suitable for dispensing liquid from the outlet opening 4 by the reversible hinge formed by the resilient piece 8 and the hinge portion 7.

Thus, according to this aspect of the present invention, the externally exposed part of the hinge portion is minimized, and the external projections are totally eliminated. Also, the handling of the cap of this type and the external appearance can be substantially improved. Furthermore, these advantages are provided without increasing the number of component parts or complicating the structure.

Figure 10:
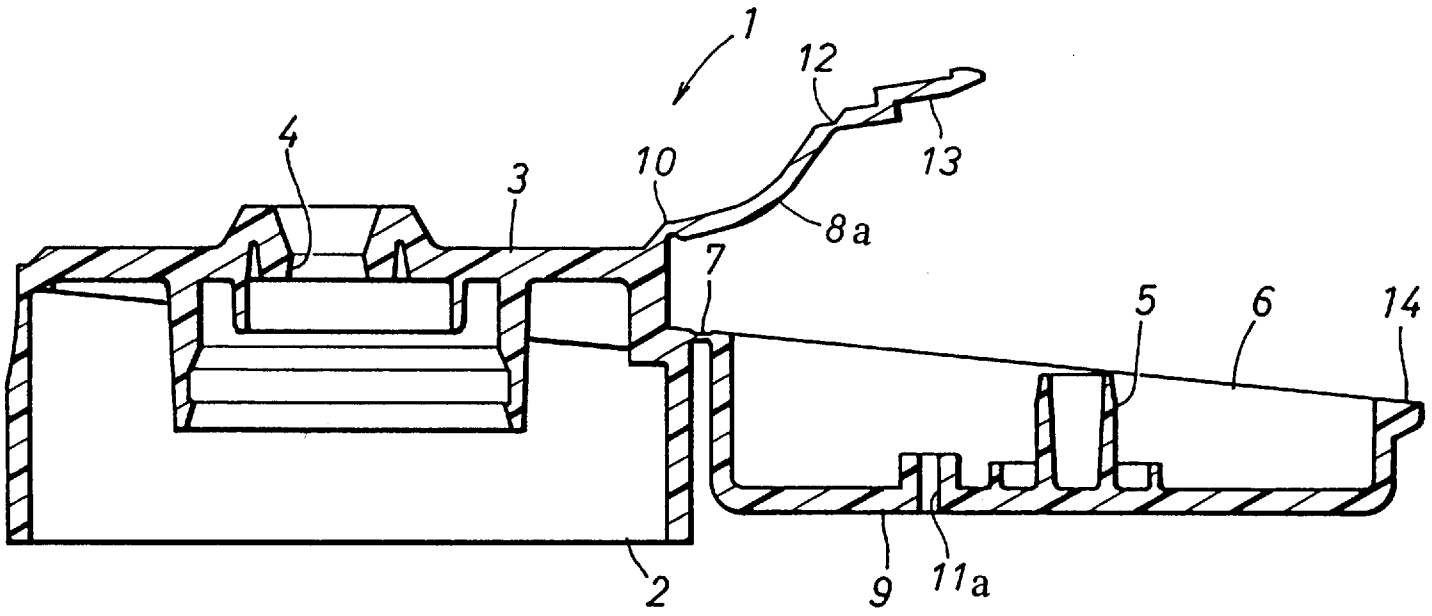
FIG. 10 is a longitudinal sectional view of the container cap of the first embodiment wherein the engagement piece and slit are in reversed positions on the secondary cap and primary cap.

As illustrated in FIG. 10 the free end of the resilient piece 8*a* can extend from the primary cap 2 rather than the secondary cap 6 as in FIG. 2, with that free end readily attached by snap fitting it into a slit 11*a* formed in the secondary cap 6. The other numbered parts in FIG. 10 correspond to the same numbered parts as in FIG. 2.

FIGS. 4 to 9 show a second embodiment of the container cap according to the present invention. The cap 21 is injection molded in the developed or unfolded condition as shown in these drawings, and comprises a primary cap 22 which is generally cylindrical and cup-shaped and adapted to be fitted onto an opening of a container main body (not shown in the drawings) and a secondary cap 26 having a plug member 25 for closing an outlet opening 24 provided in a top wall 23 of the primary cap 22. The cap 21 is integrally molded from highly resilient synthetic resin material such as polypropylene.

The primary cap 22 and the secondary cap 26 are connected with each other via a reversible hinge 29 consisting of a pair of flexible hinge portions 27 and an L-shaped resilient piece 28 so that the elastic biasing force acting on the secondary cap 26 may reverse its direction from the closing direction to the opening direction and vice versa at a certain critical opening angle.

The primary cap 22 is integrally molded with a push opener 30 which consists of a pressure member 33 connected to a lower portion of a side wall 31 of the primary cap 22 via a hinge portion 32, and a slide member 35 connected to a free end of the pressure member 33 via a hinge portion 34. The slide member 35 is provided with a slot 36 fitted on an annular projection of the outlet opening 24 in a middle part thereof, a pair of projections 38 each provided with a tapered surface 37 on an upper surface thereof and arranged on either side of the slot 36, and an abutting piece 39 extending from a free end of the slide member 35.

An inner surface of the secondary cap 26 is provided with a plug member 25 projecting therefrom and adapted to be fitted into the outlet opening 24 of the primary cap 22 as mentioned previously, and a pair of triangular projections 40 which can engage with the tapered surfaces 37 of the projections 38 of the slide member 35.

A pair of lateral projections 41 are provided on either side of the slide member 35, and can engage with slots 43 provided on either inner side of a complementary slide member receiving recess 42 formed in the top wall of the primary cap 22.

Now the operation of this embodiment is described in the following. First of all, the pressure member 33 in its unfolded condition is bent at the hinge portion 32, and is placed against the side wall 31 of the primary cap 22. The slide member 35 is then bent at the hinge portion 34, and placed against the top wall 23 of the primary cap 22. By pushing the lateral projections 41 provided on the lateral sides of the slide member 35 into the slots 43 provided on the inner sides of the complementary slide member receiving recess 42, the slide member 35 is prevented from rising (refer to FIG. 7). In this condition, the primary cap 22 is fitted onto the opening of a container main body in advance.

Figure 8:
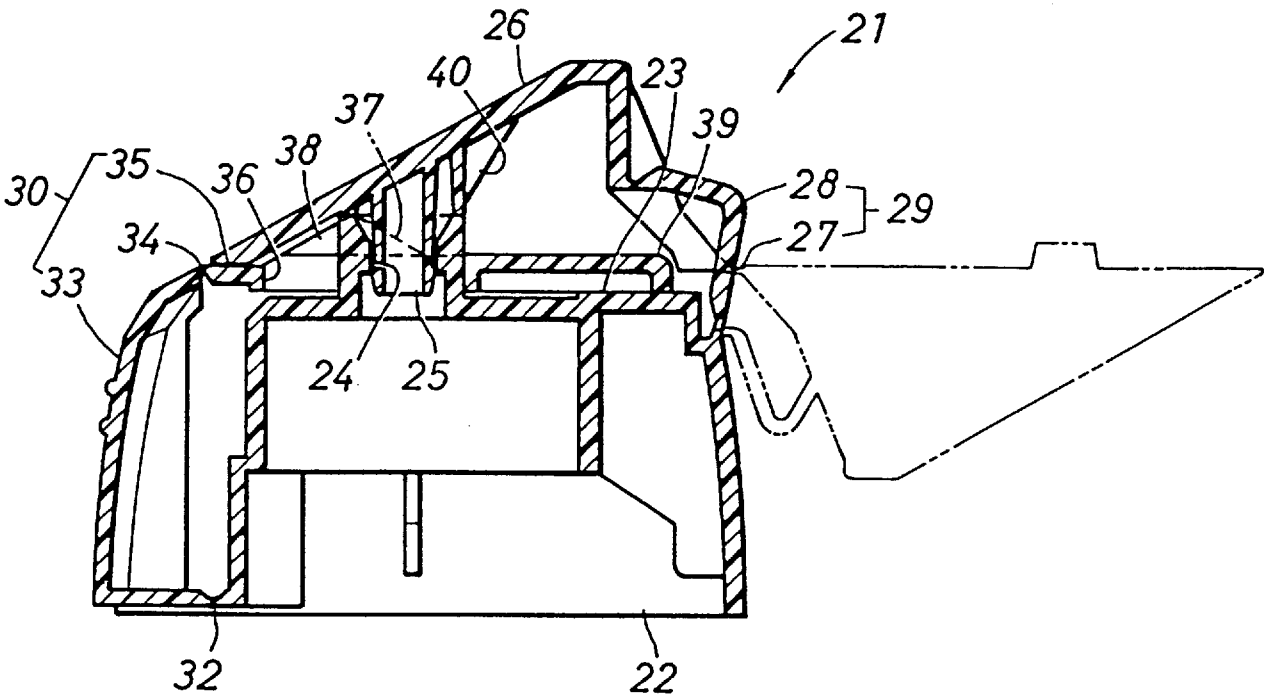
FIG. 8 is a longitudinal sectional view of the container cap of FIG. 4 with the secondary cap closed.

The secondary cap 26 is turned about the reversible hinge 29, and the tip of the plug member 25 on the inner side of the secondary cap 26 is fitted into the outlet opening 24 of the primary cap 22. The tip of the plug member 25 is slightly oversized as compared to the outlet opening 24, and can be kept engaged in the outlet opening 24 by virtue of its own elasticity in a liquid tight condition (FIG. 8). The outlet opening 24 is also provided with an annular lip which contributes to the resilient tight fit of the plug member 25 in the outlet opening 24. When the secondary cap 26 is fully closed as illustrated in FIG. 8, the reversible hinge 29 produces an elastic biasing force which tends to close the secondary cap 26.

When the pressure member 33 is pressed, the slide member 35 makes a sliding movement, and the tapered surfaces 37 of the projections 38 of the slide member 35 engage the corresponding tapered surfaces of the projections 40 on the inner surface of the secondary cap 26, thereby pushing up the secondary cap 26. As a result, the plug member 25 is disengaged from the outlet opening 24. In this condition, the reversible hinge 29 produces an elastic biasing force which still tends to close the secondary cap 26.

Figure 9:
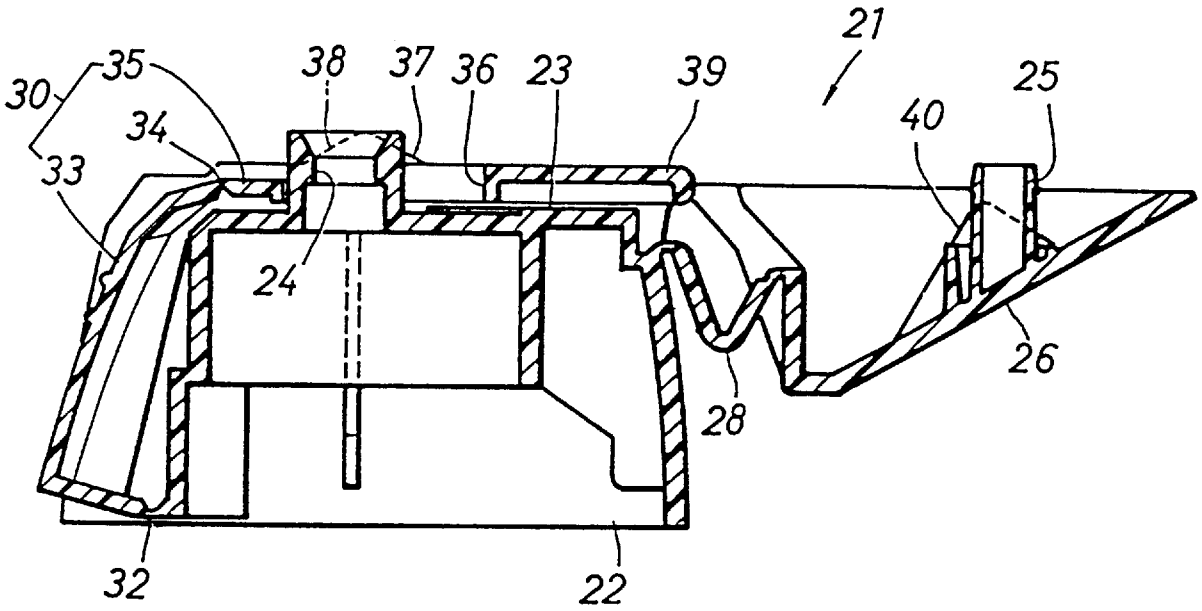
FIG. 9 is a longitudinal sectional view of the container cap of FIG. 4 with the secondary cap opened.

When the pressure member 33 is further pressed, the projecting piece 39 on the free end of the slide member 35 pushes the inner surface of the reversible hinge 29, in particular the inner surface of the resilient piece 28, and opens the secondary cap 26. When the secondary cap 26 is fully opened, the reversible hinge 29 produces an elastic biasing force which tends to keep the secondary cap 26 open, and the secondary cap 26 is thereby kept open as illustrated in FIG. 9. When the pressure member 33 has ceased to be pressed, the slide member 35 and the pressure member 33 are automatically returned to their initial positions by the restoring forces of the respective hinge portions 32 and 34.

When the secondary cap 26 is desired to be closed, the secondary cap 26 is turned with a finger, and the tip of the plug member 25 is fitted into the outlet opening 24 of the primary cap 22.

Thus, according to the present invention, the container cap can be integrally molded from synthetic resin material, and can be opened up with a single touch with the result that the handling of the cap can be significantly improved without increasing the necessary number of component parts.

Although the present invention has been described in terms of specific embodiments, it is possible to modify and alter details thereof without departing from the spirit of the present invention. For instance, the outlet opening of the primary cap was closed by a plug member projecting from the inner surface of the secondary cap in the above described embodiments, but it can be replaced with other equivalent structures. For instance, the inner surface of the secondary cap may be provided with a cup shaped closure member, instead of a plug member, which fits onto an annular boss surrounding the outlet opening of the primary cap.

What we claim is:

1. A container cap integrally molded from synthetic resin material, comprising:

a primary cap adapted to be fitted on an opening of a container, and provided with an outlet opening in a top wall thereof; and a secondary cap attached to said primary cap with hinge means, and provided with a plug member adapted to be closely fitted into said outlet opening of said primary cap;

said hinge means comprising a thin strip integrally molded with a top end of said primary cap and a bottom end of said secondary cap, and a resilient piece integrally molded with one of said primary cap and said secondary cap and attached to the other of said primary cap and said secondary cap, in each case, at a point slightly more inwardly than said thin strip, said resilient piece being configured as a reversible hinge which reverses a direction of a biasing force thereof at a certain critical opening angle of said secondary cap; and wherein said resilient piece is attached to the other of said primary cap and said secondary cap by a snap fitted engagement with a slit formed in the other of said primary cap and said secondary cap.

2. A container cap according to claim 1, wherein said primary cap is generally cylindrical in shape, and said thin strip joins an upper axial end of a side wall of said primary cap with an associated lower peripheral portion of said secondary cap.

3. A container cap according to claim 1, wherein said resilient piece is provided with a pair of thinned portions provided adjacent to said primary cap and said secondary cap, respectively.

4. A container cap according to claim 1, wherein said secondary cap is provided with a finger catch on a side wall diagonally opposite to said hinge means.

5. A container cap according to claim 1 wherein said resilient piece extends integrally from the primary cap.

6. A container cap according to claim 1 wherein said resilient piece extends integrally from the secondary cap.

7. A container cap according to claim 1, wherein said resilient piece extends from an inner surface of a top wall of said secondary cap and said resilient piece includes a tip end which is in the snap fitted engagement with a slit formed in a top wall of said primary cap.

* * * * *